United States Patent [19]

Andersson

[11] 3,994,418

[45] Nov. 30, 1976

[54] METHOD OF FEEDING MATERIAL TO A GAS GENERATOR

[75] Inventor: Karl Erik Gustav Andersson, Motala, Sweden

[73] Assignee: AB Motala Verkstad, Motala, Sweden

[22] Filed: Feb. 20, 1975

[21] Appl. No.: 551,424

Related U.S. Application Data

[63] Continuation-in-part of Ser. No. 367,097, June 5, 1973, Pat. No. 3,884,397.

[30] Foreign Application Priority Data

June 15, 1972 Sweden ..... 7914/72

[52] U.S. Cl. ..... 222/1; 48/86 R; 100/244; 100/251; 100/269 B; 222/361

[51] Int. Cl.[2] ..... G01F 11/10

[58] Field of Search ..... 222/1, 334, 361; 141/81, 249; 100/244, 251, 269; 48/86 R

[56] References Cited

UNITED STATES PATENTS

| | | | |
|---|---|---|---|
| 2,697,979 | 12/1954 | MacMurray | 100/244 X |
| 3,438,320 | 4/1969 | Raab | 100/244 X |
| 3,626,446 | 12/1971 | Fedorovna | 222/334 |

*Primary Examiner*—Robert B. Reeves
*Assistant Examiner*—John P. Shannon
*Attorney, Agent, or Firm*—Wigman & Cohen

[57] ABSTRACT

This disclosure relates to a method and apparatus for feeding material to a gas generator. A cell feeder is provided for preventing backflow of gases through the feeding apparatus from the gas generator. The cell feeder includes a housing having an axial passage extending therethrough defining a path of travel for material from an inlet opening to an outlet opening, first and second pistons mounted in the housing for compressing and transferring material received in the housing along the path from the inlet to the outlet, each of the pistons also alternately blocking and unblocking the path whereby material received within the housing will be compressed prior to the opening of the outlets, thereby preventing the backflow of gases.

1 Claim, 6 Drawing Figures

FIG. 2III

METHOD OF FEEDING MATERIAL TO A GAS GENERATOR

CROSS REFERENCE TO RELATED APPLICATION

This application is a continuation-in-part application of Ser. No. 367,097, filed June 5, 1973, now U.S. Pat. No. 3,884,397.

BACKGROUND OF THE INVENTION

This invention relates to a method and apparatus for charging material to a gas generator by means of a cell feeder to prevent gas from backing up from the gas generator through the cell feeder during the charging step.

It is known to feed material to gas generators by means of cell feeders. The material is fed to the gas generators by introducing the material to the cell-like compartments of the feeder from above, through an inlet opening and by causing said material to be discharged from the compartments as they pass an outlet opening.

With gas generators which operate at an overpressure, the empty feeding cells of the prior art are filled with gas which backs up from the generator and is passed to the infeed opening of the feeding cells and out thereof simultaneously as the material is charged to the cell. The outflowing non-combusted gas in addition to representing a gas loss can also cause explosions and is poisonous.

In copending application Ser. No. 367,097 there is disclosed a cell feeder of the segment type for preventing the backflow of gas therethrough from a gas generator. The cell feeder of the aforementioned copending application includes a cylindrical housing having upper and lower end walls, an inlet opening formed in the upper end wall and an outlet opening formed in the lower end wall, means for compressing material received within the housing including two segment means independently movable in the housing and adapted to close the openings, each of the segment means being shaped in the form of a cylinder sector and rotatably mounted about a common shaft, and means for driving each of the segment means whereby material received within the housing will be compressed prior to unblocking of the outlet opening thereby preventing the backflow of gas therethrough from the gas generator.

SUMMARY OF THE INVENTION

It is a primary object of the instant invention to provide an apparatus for preventing the emission of gases when feeding material to a gas generator by means of a cell feeder of the piston type as distinguished from a cell feeder of the segment type, as disclosed in the aforementioned copending application.

More particularly, it is an object of this invention to provide apparatus for feeding material to a gas generator comprising a cell feeder for preventing gas from backing up from the gas generator through the apparatus, the cell feeder including a housing having an axial passage extending therethrough defining a path of travel for material from an inlet opening to an outlet opening, means for compressing and transferring material received in the housing along the path from the inlet to the outlet, the compressing and transferring means including first and second piston means mounted in the housing and movable through the passage alternately blocking and unblocking the path, means for independently driving each of the piston means, and wherein the driving means includes means for yieldingly braking one of the piston means.

Another object of this invention is to provide a method of feeding material to a gas generator by means of a cell feeder having a path of travel therethrough from an infeed opening to an outfeed opening to prevent gas from backing up from the generator through the cell feeder during the feeding operation, comprising the steps of:

a. delivering the material to the cell feeder through the infeed opening thereof while keeping the path of travel therethrough to the outfeed opening closed, b. transferring the material along the path of travel to a position over the outfeed opening while compressing the material to prevent gas from passing therethrough from the gas generator through the path of travel to the infeed opening, and c. decompressing the material to release the same through the outfeed opening into the gas generator.

With the above and other objects of the invention that may become apparent hereinafter, the nature of the invention may be more clearly understood by reference to the several views illustrated in the attached drawings, the following detailed description thereof, and the appended claimed subject matter:

In The Drawings:

FIG. 1 is a vertical sectional view through the piston type cell feeder of the invention, and FIGS. 2I–2V illustrate the different steps when feeding material to a gas generator by means of the piston type cell feeder of the invention.

DETAILED DESCRIPTION OF PREFERRED EMBODIMENT

Figure 1:
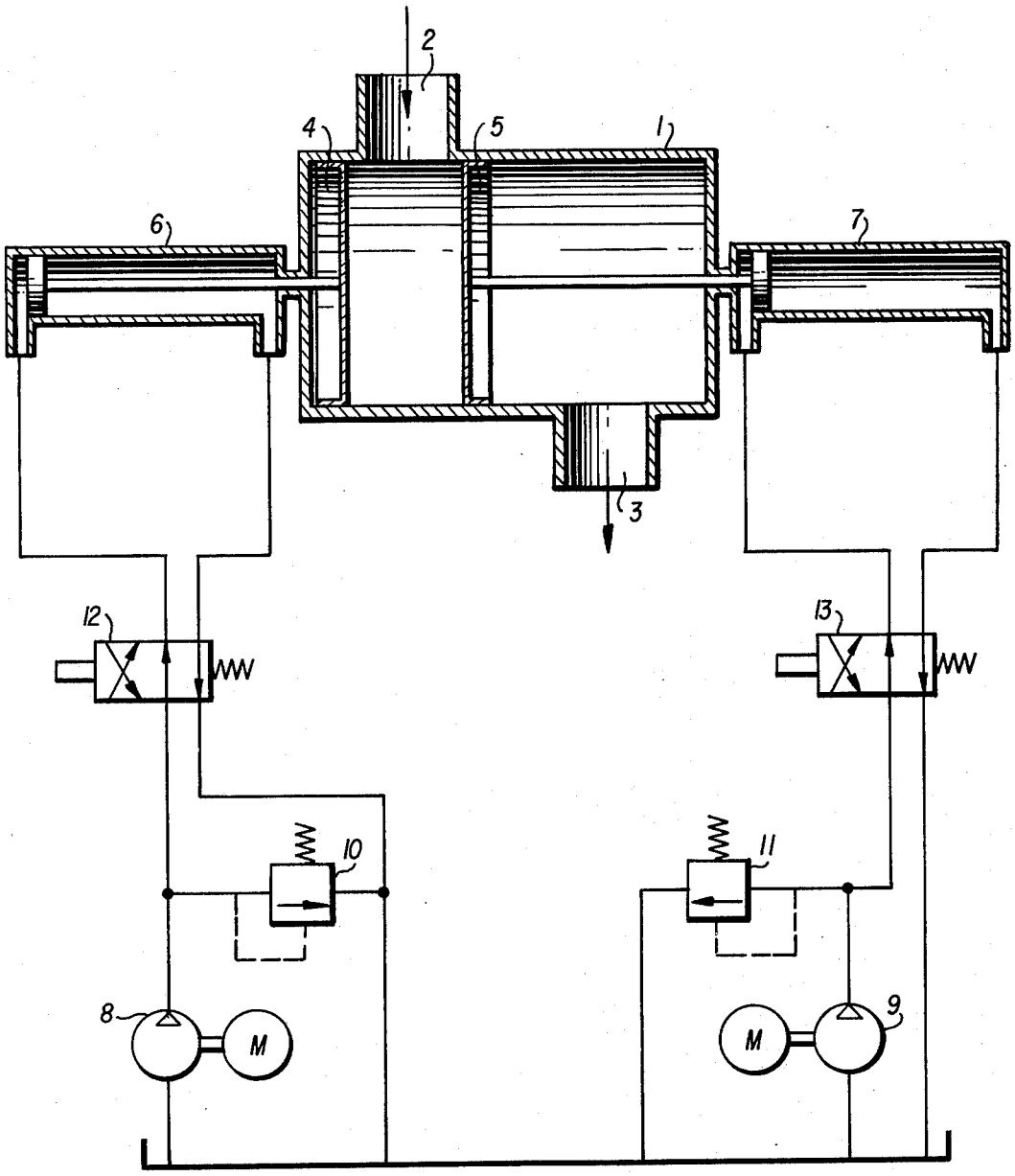
Figure 2I:
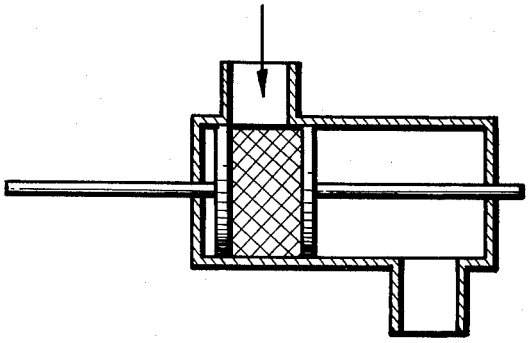
Figure 2I:
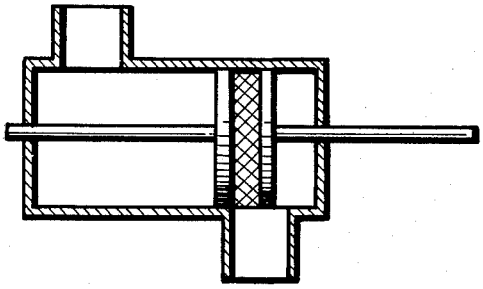
Figure 2I:
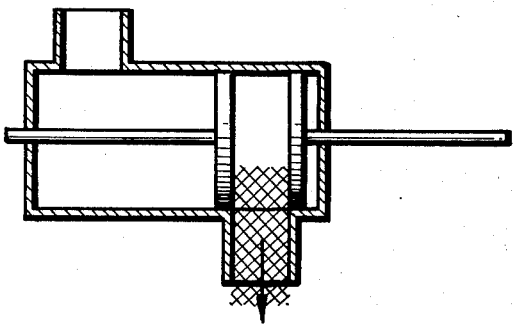
Figure 2I:
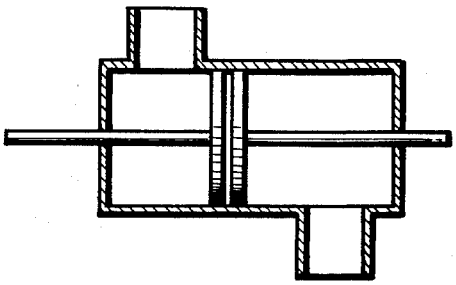
Figure 2V:
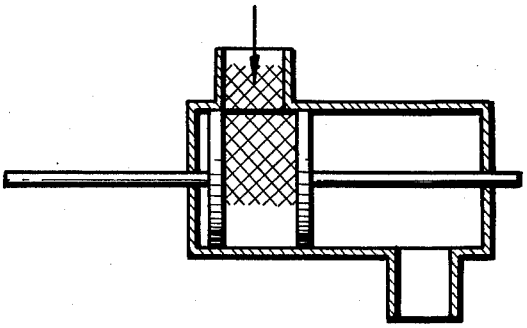

The piston type cell feeder illustrated in FIG. 1 and FIG. 2 comprises a cylindrical housing 1 provided with an axial passage having an infeed opening 2 and an outfeed opening 3. Arranged in the housing are two pistons 4 and 5, each of which is activated by its respective push-pull means 6 and 7, each comprising a conventional cylinder and piston arrangement. Each one of the push-pull means 6, 7 are driven through separate hydraulic circuits by pressure fluid pumps 8 and 9, and the movement is controlled by means of direction valves 12 and 13. The pressure fluid path is provided with overflow valves 10 and 11 in a manner known per se. The pressure fluid pump 8 and the overflow valve 10 provide a pressure which is greater than the pressure from the pressure fluid pump 9 and the overflow valve 11, taken together with the frictional force which occurs between the material and the wall of the housing 1 when the material is pressed from the infeed opening 2 to the outfeed opening 3. Referring now to both FIGS. 1 and 2, the mode of operation of the cell feeder is as follows:

The material is introduced to the cell feeder through the infeed opening 2, between the two pistons 4 and 5 at step I (FIG. 2), at which point the path defined by the axial passage in the housing 1 between the infeed opening 2 and the outfeed opening 3 is closed or blocked by the piston 5. When the cell feeder has been filled with material the direction valve 12 is actuated so that the push-pull means 6 will press the material against the piston 5 by means of the piston 4. Because the force of the fluid pressure acting to restrain retraction of the push-pull means 7, plus the frictional force of the material against the housing 1, is less than force applied by the push-pull means 6, the pistons 4 and 5 are moved to step II and the pressure fluid in the push-pull means 7 passes out through the overflow valve 11. During this phase of the operation, no gas can back up from the generator through the outfeed opening 3 to the infeed opening 2, because the piston 4 blocks the path to the infeed opening 2, as well as because the material has been compressed between the pistons 4, 5.

When the piston 4 and the push-pull means 6 have reached their respective outermost extended position, the direction valve 13 is actuated so that the push-pull means 7 moves the piston 5 to its innermost retracted position at step III, whereby the material is decompressed and leaves the cell feeder by falling down into the gas generator (not shown). Thereupon the direction valve 13 is actuated so that the push-pull means 7 moves the piston 5 to its outermost extended position. In this position, step IV, the pistons 4 and 5 confront each other and any gas contained between the pistons 4, 5 is expelled through the outfeed opening 3. At step V the direction valve 12 is actuated so that the push-pull means 6 moves the piston 4 to its innermost retracted position and the infeed opening 2 is uncovered. In this position the piston 5 blocks the path between the infeed opening 2 and the outfeed opening 3. New material can now be supplied to the cell feeder at the starting position at step I.

Because the pressure of the pressure fluid to the push-pull means 6 is kept higher than the pressure to the push-pull means 7, and the pressure path to the push-pull means 7 is provided with an overflow valve 11, the piston 5 can be pressed back to the right (i.e., retracted) while being yieldingly braked which results in a compression of the material between the pistons 4, 5 whereby a satisfactory seal against outflowing gases from the gas generator is achieved.

Although only a preferred embodiment of the invention has been specifically illustrated and described herein, it is to be understood that minor modifications could be made therein without departing from the spirit of the invention.

I claim:

1. A method of feeding material to a gas generator by means of a cell feeder having a path of travel therethrough from an infeed opening to an outfeed opening to prevent gas from backing up from the generator through the cell-feeder during the feeding operation, comprising the steps of:

a. delivering the material to the cell feeder through the infeed opening thereof while keeping the path of travel therethrough to the outfeed opening closed;

b. receiving the material between two pistons and transferring the material along the path of travel to a position over the outfeed opening while compressing the material between the two pistons to prevent gas from backing-up from the gas generator through the path of travel to the infeed opening;

c. said step of compressing being accomplished by positively driving one of the pistons in one direction along the path while yieldingly braking the movement of the other of the pistons in said one direction in response to the driving pressure applied by the one piston;

d. releasing the material through the outfeed opening into the gas generator by positively driving the other piston in said one direction away from the one piston while the one piston keeps the path of travel to the infeed opening closed; and e. thereafter positively driving the other piston in a direction opposite to said one direction to close the path of travel from the infeed opening thereby preventing gas from passing therethrough when the one piston is retracted to a position permitting the delivering of material into the cell feeder through the infeed opening.

* * * * *